United States Patent [19]

Browne

[11] Patent Number: 4,860,470

[45] Date of Patent: Aug. 29, 1989

[54] SINGLE CORE DISPLAY DEVICE

[75] Inventor: John Browne, Georgetown, Canada

[73] Assignee: NEI Canada Limited, Rexdale, Canada

[21] Appl. No.: 151,286

[22] Filed: Feb. 1, 1988

[51] Int. Cl.[4] ..... G09F 9/00

[52] U.S. Cl. ..... 40/449; 340/815.05; 40/492

[58] Field of Search ..... 40/446, 449, 492; 340/815.05, 815.26, 815.27

[56] References Cited

U.S. PATENT DOCUMENTS 3,295,238 1/1967 Winrow ..... 40/449

3,624,941 12/1971 Chantry ..... 40/449

4,531,318 7/1985 Chang et al. ..... 40/449

4,577,427 3/1986 Browne ..... 40/449

*Primary Examiner*—Richard J. Apley

*Assistant Examiner*—J. Welsh

[57] ABSTRACT

An electromagnetic display device has a rotor rotatable between limiting positions and in said limiting positions to display contrasting faces in the viewing direction. The drive for the rotor uses a permanent magnet mounted on the rotor eccentrically of the rotary axis and a stator core mounted behind the rotor and on a line intersecting the rotor axis and parallel to the viewing direction.

26 Claims, 2 Drawing Sheets

SINGLE CORE DISPLAY DEVICE

This invention relates to an electromagnetic display device of the type where a rotor of the device is a thin, relatively flat element pivotal about an axis approximately parallel to the median plane of the rotor which is contrastingly colored on opposite sides and driven between two limiting positions to provide contrasting indications in a viewing direction depending on its orientation and where a magnet on the rotor is electromagnetically controlled by a stator core member on the stator to assume the orientations.

DEFINITIONS

The "viewing direction" herein refers to the direction from the display device to the central position in the intended viewing area for the device.

"Forwardly" and "rearwardly" refer to directions corresponding to and opposite to the viewing direction 'respectively'.

BACKGROUND OF INVENTION

U.S. Pat. 4,577,427, dated Mar. 25, 1986 and issued to the assignee herein shows an electromagnetic display device of the foregoing type wherein the housing includes a pair of high remanence magnetically reversible cores for driving the magnet and the rotor. The cores are oppositely magnetized and drive a rotor magnet which has its magnetic axis in the plane of the rotor between a pair of limiting positions in each of which a contrasting face of the rotor is displayed in the viewing direction.

The patented device is quite useful but it has been found that a more economical device can be provided by using a single high remanence reversible stator core having its forward free end located on a line parallel to the viewing direction extending rearwardly from the rotation axis, to drive a rotor magnet having its polar axis perpendicular to the plane of the rotor. In this way a more economical device is obtained using only one drive core instead of two. Moreover, a simple magnetic drive is obtained because the rotor magnet is polarized perpendicular to the viewing direction, the single core may drive the rotor between limiting positions which may be, if desired, considerably greater than 180° apart measured in the angle of rotation of the rotor between limiting positions.

Accordingly it is an object of the invention to provide an electromagnetic rotor of thin flat shape pivoted about a central axis in the plane of the device which is driven by a single high remanence core having its forward free end located near a line parallel to the viewing direction and passing through the rotary axis and where the rotor has a permanent magnet magnetized perpendicular to the median plane of the rotor. The magnet is located assymetrically relative to the rotor axis to provide the required drive torque when the core is switched.

In a preferred form of the invention, the magnet is made thin and flat to conform to the flat shape of the rotor element as a whole.

In a preferred form of the invention the thin generally flat magnet has a length dimension greater than its width with the length dimension generally parallel to the rotary axis. This arrangement takes advantage of the fact that the main flux of a thin flat magnet is developed adjacent the edges. Accordingly the magnetic effects are enhanced by providing the magnet as a long thin shape and the flux along each of the long edges is used to assist the drive of the rotor by the core.

The thin, generally flat magnet, as discussed, is preferably inserted as part of the middle layer of a rotor formed as a three layer laminate or 'sandwich', the rotor being constructed as defined in Pat. No. 3,871,945 dated Mar. 18, 1975 and 3,953,244 dated Apr. 27, 1976 and held by the assignee of this application.

Such thin generally flat magnet may be made in various ways but for the best combination of high coercivity and remanence with sufficient structural qualities for handling during construction, it has been found best to use a plastic bonded ferrite which may be injection molded to the thin shape desired for the flat shape and the laminated construction.

It is an object of a preferred form of the invention to provide a stator core whose forward free end is rearward of the rotor and aligned with the line from the axis parallel to the viewing direction. The core is designed and located to project into the path of the rotor. The edge of the rotor is thus provided with a cut-out to allow the rotor to pass the projecting core end. This allows the core end to be brought closer to the locus of the magnet in its travel from one limiting position to its other, improving the magnetic torque.

It is an object of the invention using the rotor with the edge cut-out to provide rotor stops, supported on the housing, which define the limiting position for the rotor, which stops are disposed on opposite sides of the rotor axis. The stops are so located that each respectively acts on that portion of the rotor which is symmetrically disposed across the rotor axis from the cut-out. In this arrangement the cut-out in part of the range of rotation of the device, allows the disk, in its movement between limiting positions, to clear that stop which is not in use. This effectively enlarges the permissable rotation angle of the rotor while allowing convenient arrangement of the stops. This cut-out also provides clearance for the forward-extending portion of the stator core.

BRIEF DESCRIPTION OF THE DRAWINGS

In drawings which illustrate preferred embodiment of invention.

SPECIFIC EMBODIMENT

Figure 1:
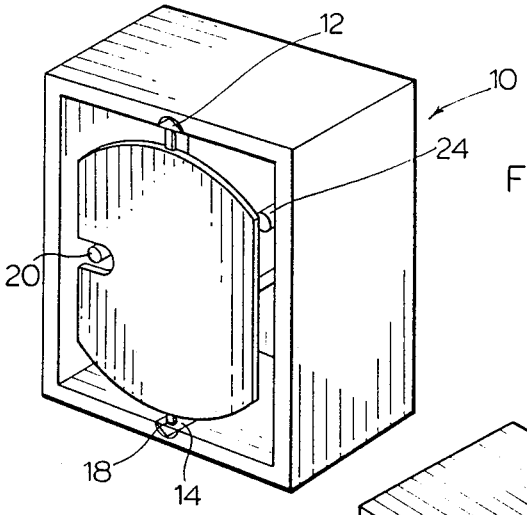
FIG. 1 shows a front view of a display device in accord with the invention.
Figure 2:
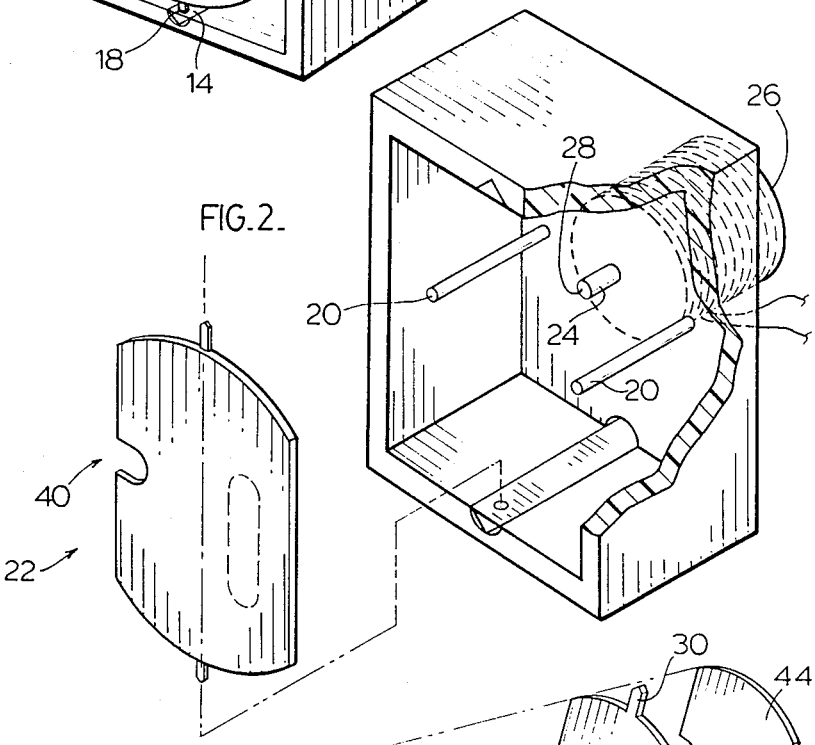
FIG. 2 is an exploded view of the device of FIG. 1.
Figure 3:
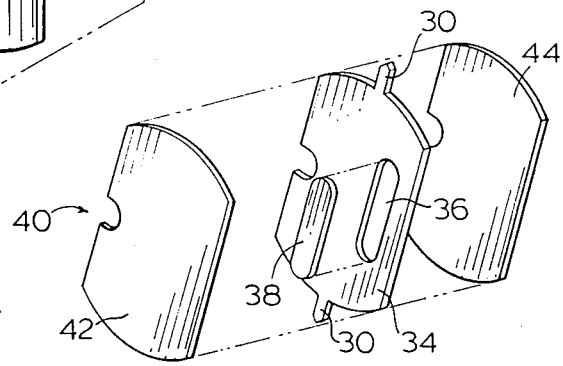
FIG. 3 is an exploded view of the preferred form of rotor construction

Although the preferred embodiment is discussed herein with reference to a single display device, it will be realized that such devices are frequently used in multiple arrays, and in rows and columns and that a number of housings complete with rotors are frequently combined in a single unit.

In the drawings a molded plastic housing 10 has sides and a back and opens forwardly in the viewing direction. Posts 12 and 14 mounted in the end walls of the housing provide pivotal mountings for the rotor and define the rotary axis between bearing depressions 16 and 18. Intermediate the pivot mountings a pair of stop members 20 are located on opposite sides of the housing just inwardly of the locus of the edge of the rotor 22. The stop members 20 are preferably posts projecting forwardly from the rear of the housing. They are preferably located approximately in a plane through the rotary axis perpendicular to the viewing direction. A core 24 is mounted to project forwardly through the rear wall of the housing at a location defined by a line parallel to the viewing direction through the rotary axis, midway between the bearings 16 and 18. The core 24 is, rearward of the housing provided with an energizing coil 26. The core is of high remanence, high coercivity material, hence the coil may be merely pulsed to alter the polarity of core end 28, which polarity will then be retained by the core end 26 until an opposite sense pulse is provided to the coil 26. The preferred material for the core is vicalloy. The coil is preferably a monofilament for simplicity and economy, energized by a pulse source, not shown.

The rotor is thin and relatively flat and defines a median plane being that plane which corresponds best to the location of its length and width extents. The rotor pivot pins 30 project from each end of the rotor for rotatably mounting the rotor in the depressions 16 and 18. Except for two cut-outs to be hereinafter described, the rotor is preferably symmetrical about the rotation axis as defined by its pivot pins 30 and is preferably of laminated or 'sandwich' construction as described in U.S. Pat. Nos. 3,871,945 and 3,953,244. Thus a central layer 34 of plastic is shaped to provide: pivot pins 30; and oval cut-out 36 to receive the magnet 38, and an edge cut-out 40 on a side edge, midway between the pivot pins. The oval cut-out conforming to the desired position for magnet 38 bears its long dimension parallel to the rotor axis and is located on the opposite side of the axis from cut-out 40. The magnet 38 is shaped to be received in the oval cut-out and its thickness is selected to approach as closely as possible to that of central layer 34 so that outside layers 42 and 44 are of flat contour. The magnet is poled perpendicular to its plane and therefore to the plane of the rotor.

The this profile of the magnet is designed to take advantage of the fact that the main force of the magnet occurs at its edges and the thin profile allows the edges to be close together. Thus the resultant flux perpendicular to the rotor plane, at both magnet edges is available for the electromagnetic drive by core 24.

Figure 4:
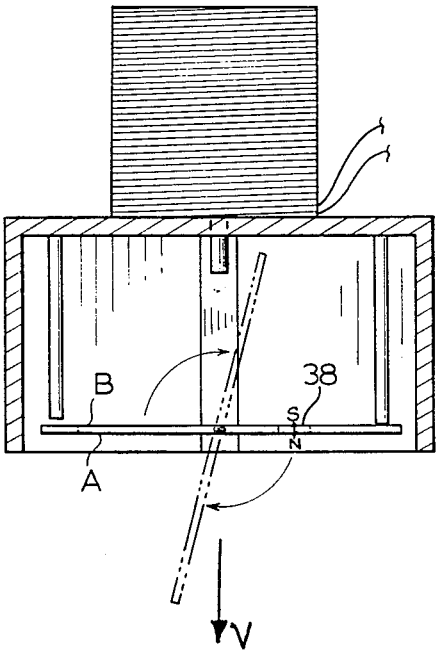
FIG. 4 is a cross-section of the device perpendicular to the viewing axis.
Figure 5:
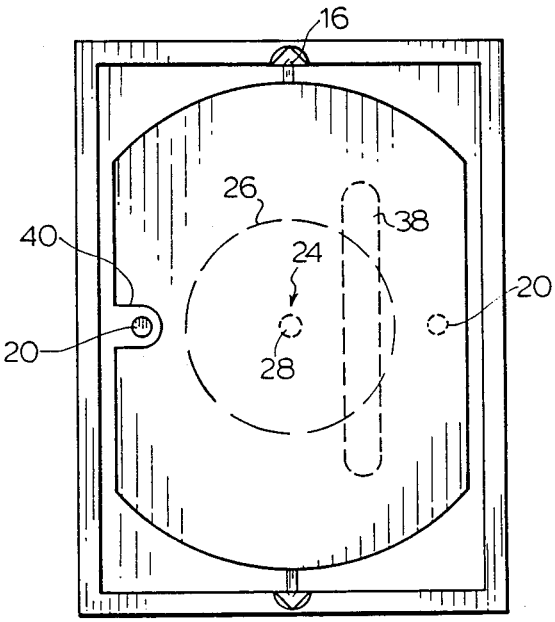
FIG. 5 is a front view of the device.

The edge cut out 40 is designed to clear the inwardly projecting core end 28 in the rotor's travel between limiting- positions and thus the core end may be brought closer to the path locus of the magnet for better torque. The cut out 40 also allows the rotor to clear the stop 20 not in use while the rotor is adjacent its rest position at the other stop. This is best demonstrated in FIG. 4 which shows the position of a stop 20 relative to cut out 40.

Thus the rotor in each limiting position leaves one of the stops visible in the viewing direction but this does not seriously interfere with the appearance of the element. The rotor material may be made flexible so that it may be bowed to be inserted in wells 16 and 18.

It will be noted that prior display devices using two cores to drive the rotor magnets are, in most designs, confined to rotations of less than 180°, the use of a single drive core with an assymetric magnet allows a much greater rotary angle if desired. It will be obvious (from an examination of FIG. 4) that by lowering the ends of stops 20 angles of at least 270° could be achieved.

It is noted that the use of an assymetric rotor magnet with a dimension greater parallel to the rotor axis than perpendicular thereto creates a magnet where the flux at both of the longer edges is available to assist in the rotor drive each time the core polarity is reversed.

It is noted that it is preferred to construct the magnet out of plastic bonded ferrite. This has been found the most suitable material for the thin laminate construction since the material provides good handling qualities with high remanence and coercivity.

In operation, and with coil 26 deenergized the remanent flux of core 24 with south pole 28 will maintain rotor 42 in one of its rest positions against a step 20. Side A of the rotor is displayed in the viewing direction V. On energizing coil 26 to reverse the polarity of core 24 and core end 28, the reverse polarity causes rotor 42 under control of its magnet 38 to move to its other limiting position resting against the other stop 20. Side B of the rotor is then displayed in viewing direction V. In moving between limiting positions it is noted that edge cut out 40 clears the stop 20 which it is leaving, then moves about core 24 in passing and then clears the other stop 20 at the final position. Once the core 24 is switched, the remanent flux of core 24 retains the rotor in position without continued energization of coil 26. When it is desired to again reverse the position of rotor 22 to display the side A in direction V, the coil 26 is pulsed in a sense to again reverse the polarity of core 24.

I claim:

1. Electromagnetic display device having a predetermined viewing direction;

a housing;

a rotor having a body of thin generally flat shape defining a median plane, mounted on said housing for rotation about an axis substantially in said median plane, said axis being approximately perpendicular to said viewing direction, a permanent magnet mounted on said rotor on only one side of said axis and having its polar axis transverse to the median plane of the rotor, said rotor being contrastingly colored on opposite sides, stop means on said housing defining an arc of movement for said rotor between two limiting positions, said permanent magnet defining a path while moving over said arc, each limiting position corresponding to the display of a different contrasting face in the viewing direction, a reversible polarity, high remanence core mounted on said housing with a free end projecting generally in the viewing direction, an energizing winding for controlling the polarity of said core, said free end being located rearward of the path of said magnet to exert selectively reversible torque to influence said magnet to move said rotor between limiting positions in an angular direction determined by the torque.

2. Electromagnetic display device as claimed in claim 1 wherein said en winding is monofilar.

3. Electromagnetic display device as claimed in claim 1 wherein said rotor is substantially symmetrical on each side of the rotation axis except for a cut out on one edge intermediate the axial length of the rotor and wherein said stops each contact the rotor at the location symmetrically disposed from said cut out.

4. Electromagnetic display device as claimed in claim 3 wherein said core is located in relation to said rotor so said core end passes through the area defined by said cut out, during movement of said rotor between limiting positions.

5. Electromagnetic display device as claimed in claim 1 wherein said magnet is shaped to be a thin generally flat layer arranged approximately parallel to the median plane, and substantially conforming to the thickness dimension of the body of the rotor.

6. Electromagnetic display device as claimed in claim 3 wherein said magnet is shaped to be a thin generally flat layer approximately conforming to the thickness dimension of the body of the rotor and where said magnet is located on the rotor on the opposite side of of said axis from said cut-out.

7. Electromagnetic display device as claimed in claim 4 wherein said magnet is shaped to be a thin generally flat layer approximately conforming to the thickness dimension of the body of the rotor and where said magnet is located on the rotor on the opposite side of said axis from said cut-out.

8. Electromagnetic display device as claimed in claim 1 wherein said magnet has a greater length than width and has its long dimension approximately parallel to the rotation axis.

9. Electromagnetic display device as claimed in claim 3 wherein said magnet has a greater length than width and has its long dimension approximately parallel to the rotation axis.

10. Electromagnetic display device as claimed in claim 4 wherein said magnet has a greater length than width and has its long dimension approximately parallel to the rotation axis.

11. Electromagnetic display device as claimed in claim 5 wherein said magnet has a greater length than width and has its long dimension approximately parallel to the rotation axis.

12. Electromagnetic display device as claimed in claim 6 wherein said magnet has a greater length than width and has its long dimension approximately parallel to the rotation axis.

13. Electromagnetic display device as claimed in claim 7 wherein said magnet has a greater length than width and has its long dimension approximately parallel to the rotation axis.

14. Electromagnetic device as claimed in claim 5 wherein said magnet is a plastic bonded ferrite.

15. Electromagnetic device as claimed in claim 6 wherein said magnet is a plastic bonded ferrite.

16. Electromagnetic device as claimed in claim 7 wherein said magnet is a plastic bonded ferrite.

17. Electromagnetic device as claimed in claim 8 wherein said magnet is a plastic bonded ferrite.

18. Electromagnetic device as claimed in claim 9 wherein said magnet is a plastic bonded ferrite.

19. Electromagnetic device as claimed in claim 10 wherein said magnet is a plastic bonded ferrite.

20. Electromagnetic device as claimed in claim 11 wherein said magnet is a plastic bonded ferrite.

21. Electromagnetic device as claimed in claim 12 wherein said magnet is a plastic bonded ferrite.

22. Electromagnetic device as claimed in claim 13 wherein said magnet is a plastic bonded ferrite.

23. Electromagnetic display device as claimed in claim 5 wherein said rotor is a laminate of three layers and the central layer is provided with a cut out area to receive sad magnet.

24. Electromagnetic display device as claimed in claim 6 wherein said rotor is a laminate of three layers and the central layer is provided with a cut out area to receive said magnet.

25. Electromagnetic display device as claimed in claim 8 wherein said rotor is a laminate of three layers and the central layer is provided with a cut out area to recieve said magnet.

26. Electromagnetic display device as claimed in claim 14 wherein said rotor is a laminate of three layers and the central layer is provided with a cut out area to receive said magnet.

* * * * *